United States Patent [19]

Parker, Jr. et al.

[11] 4,309,033

[45] Jan. 5, 1982

[54] CLAMPING APPARATUS

[75] Inventors: Charles L. Parker, Jr.; George A. Vaughn, both of Princeton, N.J.

[73] Assignee: AMF Incorporated, Plainsboro, N.J.

[21] Appl. No.: 77,040

[22] Filed: Sep. 19, 1979

[51] Int. Cl.[3] ..... A63B 51/00

[52] U.S. Cl. ..... 273/73 D

[58] Field of Search ..... 273/73 R, 73 A, 73 B, 273/73 C, 73 D, 73 E; 24/115 G, 115 M, 115 N, 122.3, 122.6, 127, 128, 130, 136 R, 136 K, 136 L, DIG. 22; 242/147 R, 149; 403/211, 275, 291

[56] References Cited

U.S. PATENT DOCUMENTS

| | | | |
|---|---|---|---|
| 1,526,734 | 2/1925 | Andrews et al. | 273/73 J X |
| 3,548,484 | 12/1970 | Carlton | 273/73 D X |
| 3,975,799 | 8/1976 | Kerr | 24/115 M X |
| 3,994,495 | 11/1976 | Stoffel | 273/73 A X |
| 4,066,368 | 1/1978 | Mastalski et al. | 24/115 M X |
| 4,118,059 | 10/1978 | Lindsay | 273/73 D |
| 4,125,259 | 11/1978 | Halbrook | 273/73 A |

FOREIGN PATENT DOCUMENTS

| | | | |
|---|---|---|---|
| 50041 | 3/1935 | Denmark | 273/73 D |
| 855446 | 2/1940 | France | 273/73 D |
| 23260 | of 1908 | United Kingdom | 273/73 D |
| 287775 | 3/1928 | United Kingdom | 273/73 D |
| 498430 | 1/1939 | United Kingdom | 273/73 D |
| 869923 | 6/1961 | United Kingdom | 24/115 M |
| 887526 | 1/1962 | United Kingdom | 273/73 D |

*Primary Examiner*—Richard J. Apley

*Attorney, Agent, or Firm*—Carella, Bain, Gilfillan & Rhodes

[57] ABSTRACT

Clamping apparatus extending through a passageway formed in the frame of a game ball racket for applying non-uniform clamping pressure to a length of a game ball string adjacent an end thereof to clamp the length of string to the game ball racket frame, the non-uniform clamping pressure is minimum at the forward or pulled end of the clamped length of string where the tensile stress produced in the clamped length of string due to stringing and play is maximum and which non-uniform clamping pressure increases to a maximum at the free or rearward end of the clamped length of string where the tensile stress therein is minimum; the tendency of the clamped length of string to rupture at the forward or pulled end of the clamped length of string where the tensile stress is maximum is reduced because the non-uniform clamping pressure applied by the clamping apparatus of the present invention is minimum at this critical point.

15 Claims, 28 Drawing Figures

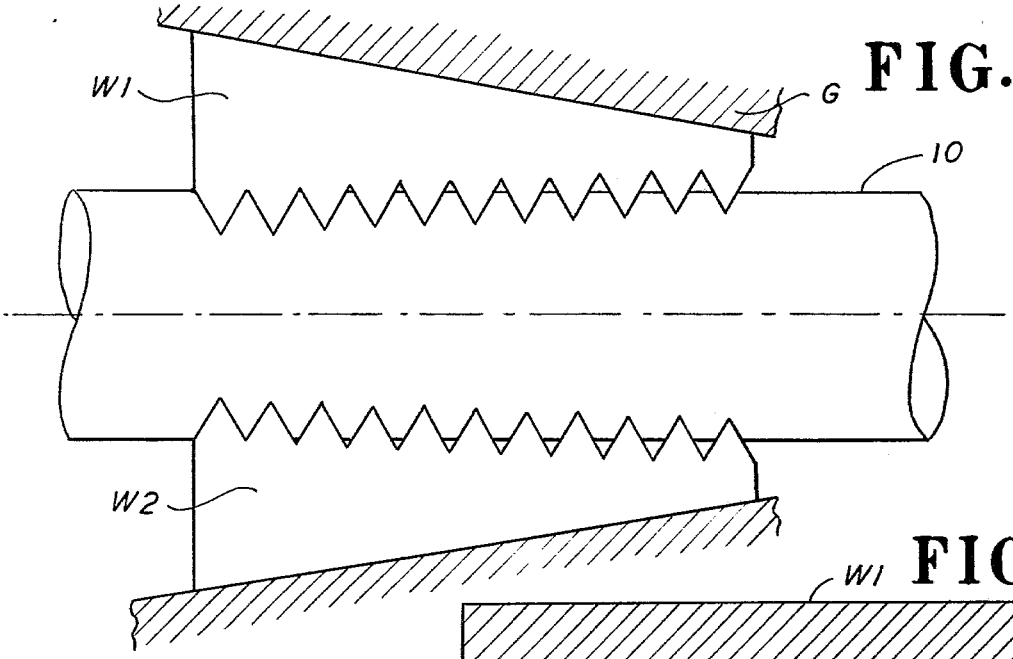
FIG. 12
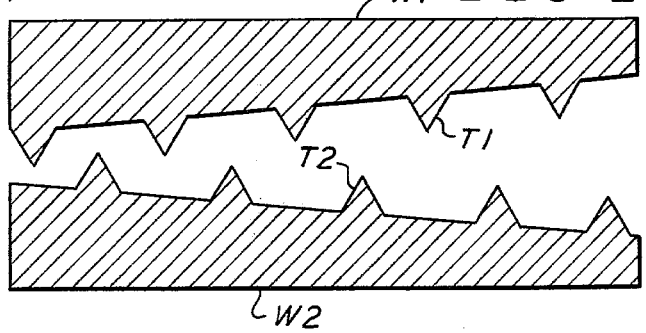
FIG. 13
FIG. 14
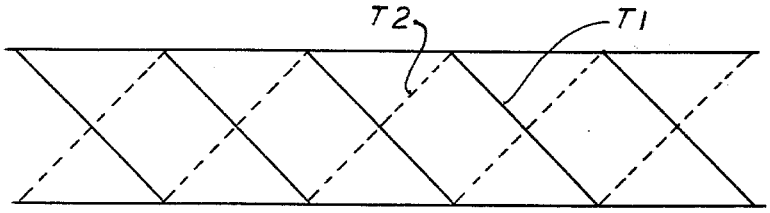
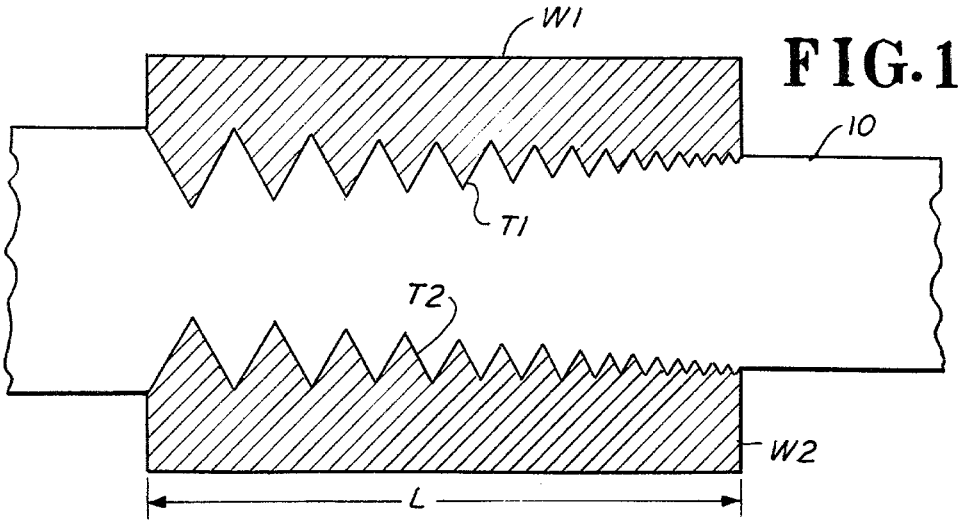
FIG. 15

CLAMPING APPARATUS

BACKGROUND OF THE INVENTION

1. Field of the Invention

This invention relates generally to clamping apparatus, and more particularly relates to new and improved clamping apparatus for clamping the ends of the strings of a game ball racket in the frame of the racket with non-uniform clamping pressure to reduce the tendency of the strings to yield or rupture along their clamped lengths due to the combination of the clamping pressure and the tensile stress produced in the clamped lengths of string due to stringing and racket play.

2. Description of the Prior Art

As is known to those skilled in the art, and as disclosed in British specification No. 23,260 date of application Oct. 31, 1908; British specification No. 887,526 date of application Dec. 19, 1958; and U.S. Pat. No. 3,994,495; clamping apparatus have been used to clamp the ends of individual game ball strings to the frame of the game ball racket. Such clamping apparatus, for example as disclosed in U.S. Pat. No. 3,994,495 includes a pair of opposed tapered wedges or ferrule halves for being wedgingly received within a tapered passageway formed in the frame of the game ball racket to clamp the end of a game ball string to the racket frame.

As is further known to those skilled in the art, such prior art clamping apparatus apply uniform clamping pressure along the clamped length of the string, and as is still further known to those skilled in the art, game ball strings clamped by such prior art clamping apparatus have a tendency to rupture at the point where such strings exit the clamping apparatus, which critical point is referred to herein as the pulled or forward end of the clamped length of the string.

Further, and as is also known to those skilled in the art, upon the game ball string being clamped tensile stress is produced in the clamped length of the string due to stringing and due to the string impacting with a game ball during racket play. Such tensile stress produced in the clamped length of the string decreases from a maximum at the forward or pulled end of the clamped length of the string to a minimum at the rearward or free end of the clamped length of string.

As is still further known to those skilled in the art, a significant factor in determining whether or not a member in stress, such as the clamped length of the string, will yield or rupture, is the equivalent (combined) stress which is a function of the tensile stress and the compressional stress produced in the member at each point therealong. Thus, it will be understood that the equivalent stress in the clamped length of the string will be maximum at the forward or pulled end of the clamped length of string where the tensile stress is maximum and where the compressional stress produced in the clamped length of string is also high due to the uniform clamping pressure which causes the compressional stress to be of a uniform maximum value along the entire clamped length of string. It is believed, as is taught in detail below, that it is the combined effect of the maximum tensile stress and high compressional stress present at the forward or pulled end of the clamped length of string which causes the tendency of the string to rupture at this critical point.

SUMMARY OF THE INVENTION

It is the primary object of the present invention to provide clamping apparatus which applies non-uniform clamping pressure to the clamped length of the game ball string whereby the compressional stress produced in the clamped length of string due to clamping pressure will be minimum where the tensile stress produced therein is maximum and wherein such compressional stress will be maximum where such tensile stress is minimum, and hence the point along the clamped length of string where the compressional stress is maximum will not cause rupture.

Clamping apparatus embodying the present invention and providing such non-uniform clamping pressure includes clamping apparatus for engaging the clamped length of string in graduated contact to thereby apply non-uniform clamping pressure to said clamped length of string which clamping pressure is minimum at the forward or pulled end of the clamped length of string where the tensile stress produced therein due to stringing and play is maximum and which clamping pressure increases to a maximum at the free or rearward end of the clamped length of string where the tensile stress produced there is minimum. Thus, by providing minimum clamping pressure where the tensile stress produced in the clamped length of string is maximum, the tendency of the string to rupture at this critical point is reduced.

DESCRIPTION OF THE DRAWINGS

FIG. 12 is a diagrammatic illustration of the improved clamping apparatus of the present invention showing the manner in which the gripping teeth reduce the tendency of the clamped string to rupture;

FIGS. 13, 14 and 15 are diagrammatic illustrations showing the manner in which the gripping teeth provided on the inner surfaces of the opposed tapered wedges of the present invention may be configured alternatively;

DESCRIPTION OF THE PREFERRED EMBODIMENT

Figure 1:
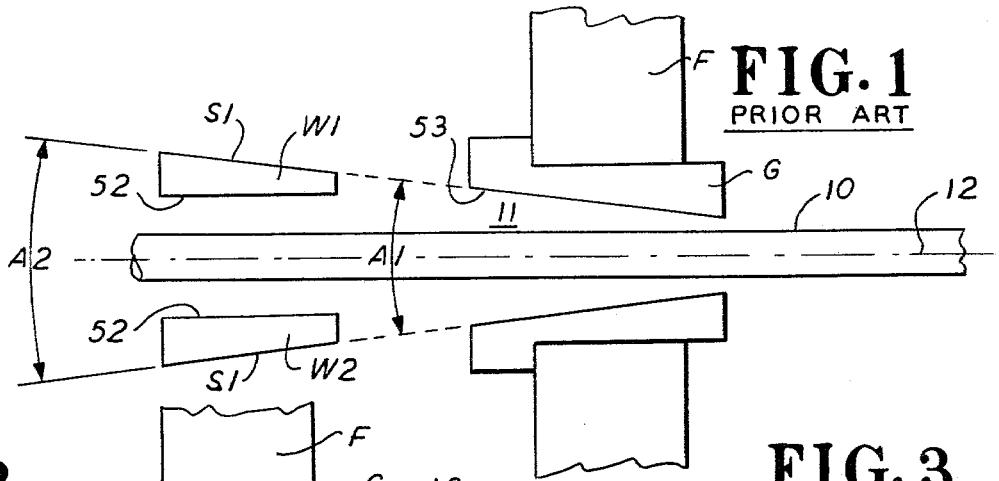
FIG. 1 PRIOR ART
FIGS. 1 and 2 are diagrammatic illustrations of clamping apparatus known to the prior art.

Referring now to FIG. 1, there is shown a diagrammatic illustration of the above-noted prior art clamping apparatus for clamping the end of a game ball racket string 10 in the frame F of a game ball racket. As also noted above, such prior art clamping apparatus typically includes a pair of opposed, tapered wedges W1 and W2 for being wedgingly received within the tapered passageway 11 formed in the grommet G and extending through the frame F of the game ball racket. The opposed tapered wedges W1 and W2 are provided with the conical outer surfaces S1—S1 and cylindrical inner surfaces S2—S2. The tapered passageway 11 extending through the grommet G is defined by the conical inner surface S3 of the grommet G.

Figure 2:
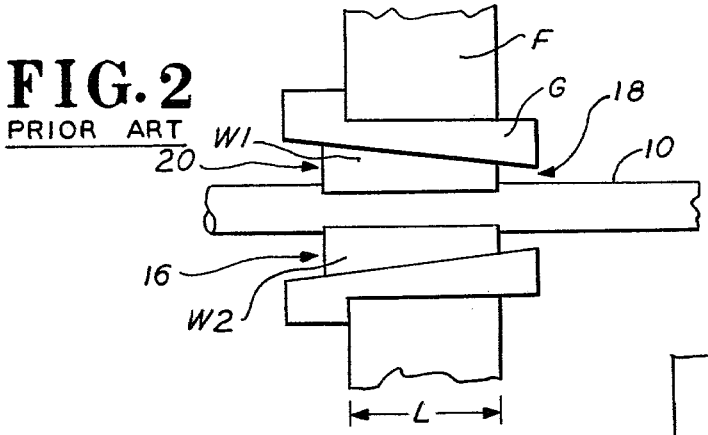
FIG. 2 PRIOR ART
Figure 3:
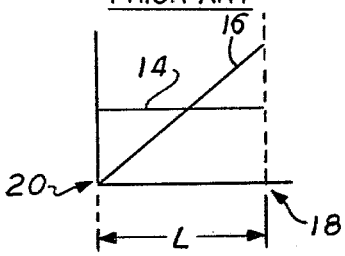
FIG. 3 PRIOR ART
FIG. 3 is a graph illustrating the tensile stress and clamping pressure produced by the prior art clamping apparatus.

It will be noted that the conical inner surface S3 of the grommet G defining the tapered passageway 11 forms an included angle A1 with respect to the centerline 12 of the string 10 and upon the inner surfaces S2—S2 of the tapered wedges W1 and W2 being aligned substantially parallel with the outer surface of the string 10 as shown in FIG. 1, the conical outer surfaces S1—S1 of the wedges W1 and W2 also form an included angle A2 with respect to the centerline 12 of the string 10. In such prior art clamping apparatus, it will be noted that the included angle A1 formed by the tapered passageway 11 is equal to the included angle A2 formed by the outer surfaces of the wedges W1 and W2. Hence, as illustrated diagrammatically in FIG. 2, upon the wedges W1 and W2 being wedgingly received within the tapered passageway 11 of the grommet G, the conical outer surfaces S1—S1 of the wedges align with the inner surface S3 of the grommet G and the cylindrical inner surfaces S2—S2 of the wedges are forced inwardly parallel to each other whereby the inner surfaces S2—S2 apply uniform clamping pressure 14 to the clamped length of the string L as shown in FIG. 3. Upon the string 10 being placed in tension due to stringing and due to the string impacting with a game ball during play, tensile stress 16, as noted above, is produced in the clamped length of string L which tensile stress 16 is maximum at the forward or pulled end 18 of the clamped length of string L and which tensile stress decreases to a minimum at the rearward or free end 20 of the clamped length of string L.

As also noted above, and as well known to those skilled in the art, upon the string 10 being clamped in the frame F of a game ball racket by such prior art clamping apparatus, the string 10 has a tendency to rupture at the forward or pulled end 18 of the clamped length of string L. It is believed that such tendency to rupture at this point is due to the combined effect of the tensile stress 16 which is maximum at this point and the clamping pressure 14 which, being uniformly applied to such clamped length of string L, is also maximum at this point.

As further noted above, if clamping apparatus could be provided which applies non-uniform clamping pressure to the clamped length of string L which non-uniform clamping pressure is minimum at the forward or pulled end 18 of the clamped length of string L and which increases to a maximum at the rearward or free end 20 of the clamped length of string L, the combined effect of the tensile stress 16 and clamping pressure 14 at the pulled or forward end 18 of the clamped length of string L would be reduced and hence the tendency of the string 10 to rupture at the forward or pulled end 18 of the clamped length of string L would also be reduced. Such non-uniform clamping pressure is applied by the clamping apparatus of the present invention as will be taught in detail below.

Figure 4:
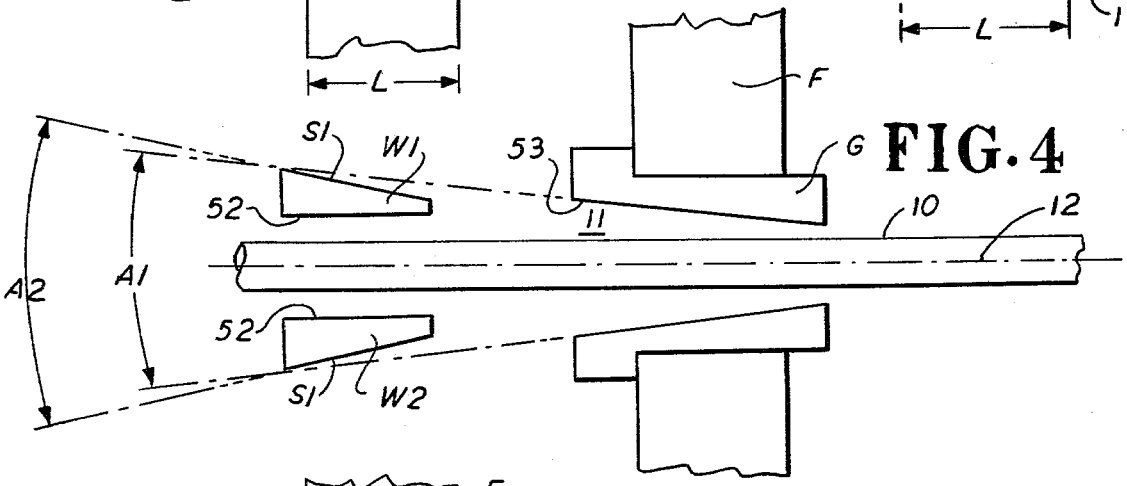
FIGS. 4 and 5 are diagrammatic illustrations of an embodiment of the improved clamping apparatus of the present invention.
Figure 5:
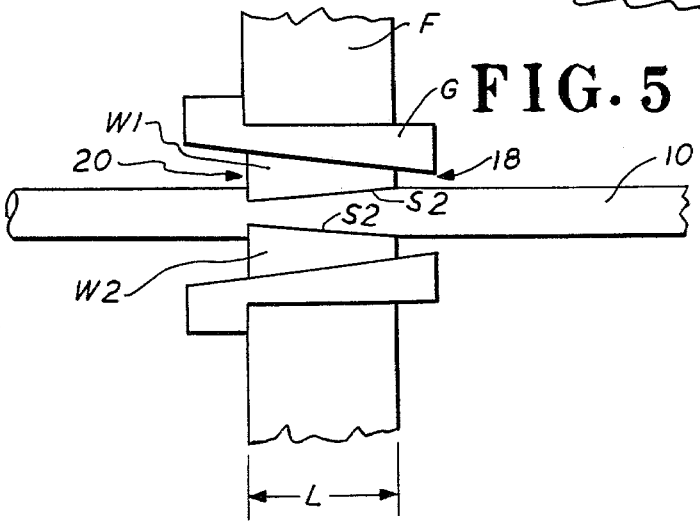
Figure 6:
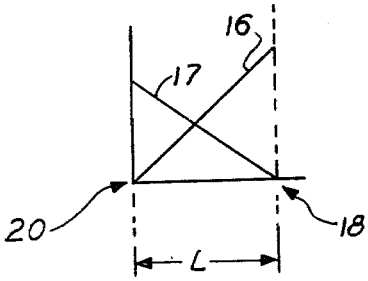
FIG. 6 is a graph illustrating the tensile stress and clamping pressure produced by the improved clamping apparatus of the present invention.

Referring now to FIG. 4, there is shown an embodiment of the improved clamping apparatus of the present invention for applying non-uniform clamping pressure to the clamped length L of the string 10. As illustrated diagrammatically in FIG. 4, the conical outer surfaces S1—S1 of the opposed tapered wedges W1 and W2 form an included angle A2 with respect to the centerline 12 of the string 10 which included angle A2 is greater than the included angle A1 formed by the conical inner surface S3 defining the passageway 11 extending through the grommet G. Hence, as illustrated diagrammatically in FIG. 5, upon the opposed tapered wedges W1 and W2 being wedgingly received within the passageway 11, the outer surfaces S1—S1 of the wedges align with the inner surface S3 of the grommet G and due to the differential taper between the included angles A1 and A2, the cylindrical inner surfaces S2—S2 of the wedges are forced towards each other in non-parallel fashion whereby such cylindrical inner surfaces S2—S2 engage the outer surface of the string 10 in graduated contact as shown in FIG. 5 and apply non-uniform clamping pressure 17 which, as shown in FIG. 6, is minimum at the forward or pulled end 18 of the clamped length of string L where the tensile stress 16 is maximum and which non-uniform clamping pressure 17 increases to a maximum at the rearward or free end 20 of the clamped length of string L where the tensile stress 16 is minimum. It has been found that clamping apparatus embodying the present invention illustrated diagrammatically in FIGS. 4–6 does reduce the tendency of the clamped length of string L to rupture at the forward or pulled end 18 of the clamped length of string L.

While not wishing to be bound by theory, the following is offered as a theoretical explanation for the unexpected beneficial results provided by the improved clamping apparatus of the present invention wherein a differential taper is provided between the included angle A2 formed by the outer surfaces S1—S1 of the wedges W1 and W2 and the included angle A1 formed by the tapered inner surface S3 of the grommet G into which the wedges are wedgingly received. Accordingly, it will be shown that non-uniform clamping pressure applied to the clamped length of string can reduce the maximum values of equivalent (combined) stress in the string below those values of equivalent stress that would be present in a string clamped with uniform clamping pressure, particularly at the critical point of the forward or pulled end of the clamped length of string L. This reduction in maximum equivalent (combined) stress will tend to reduce the incidence of string rupture or failure during installation of the string and during play with the game ball racket.

Figure 7A:
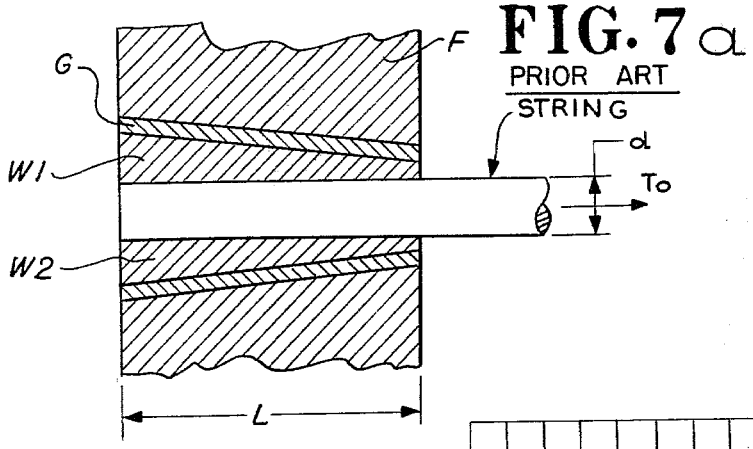
FIG. 7a PRIOR ART
FIGS. 7(*a*) and 7(*b*) are diagrammatic illustrations of a string held by uniform clamping pressure of the prior art clamping apparatus.
Figure 7B:
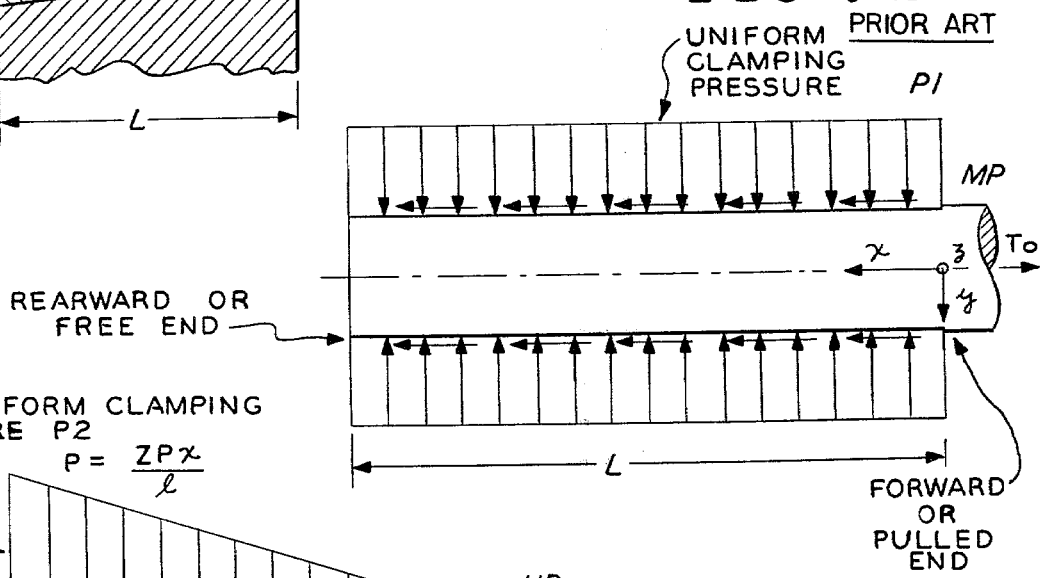
FIG. 7b PRIOR ART
Figure 8A:
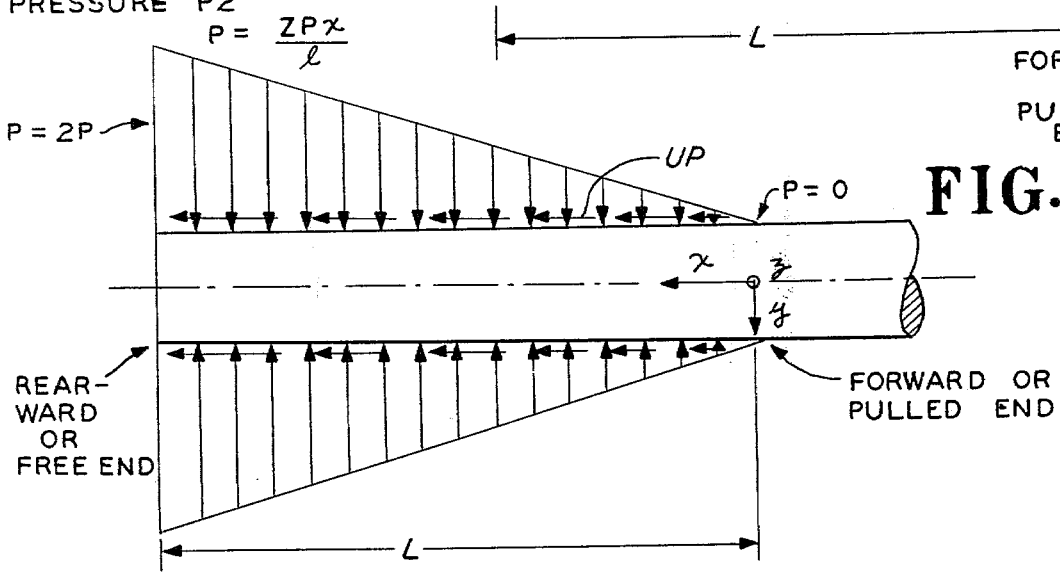
FIGS. 8(*a*) and 8(*b*) are diagrammatic illustrations of a string held by non-uniform clamping pressure as provided by the improved clamping apparatus of the present invention.
Figure 8B:
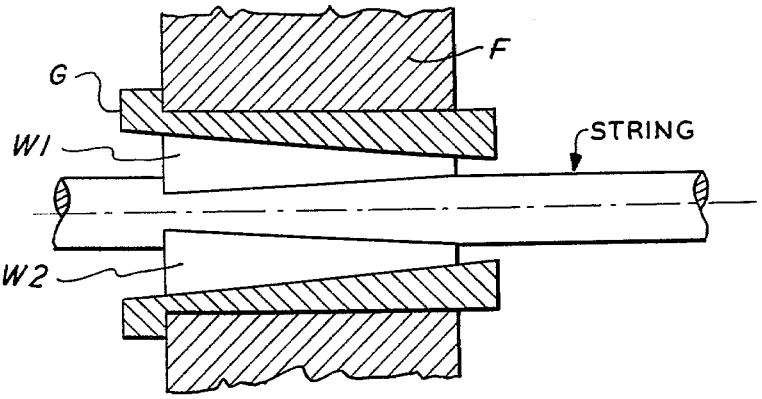

First examine two idealized cases. The first case will be where the opposed tapered wedges W1 and W2 and grommet G are configured in accordance with the prior art as shown in FIG. 1 to provide uniform clamping pressure P1 as shown in FIGS. 1 and 7(*a*). The second case will be where the opposed tapered wedges W1 and W2 are configured in accordance with the teachings of the present invention to apply non-uniform clamping pressure P2 as shown in FIG. 8(*a*) where as shown, the non-uniform clamping pressure P2 varies linearly from a minimum value of zero at the forward or pulled end of the clamped length of string L to a maximum value of 2P at the rearward or free end of the clamped length of string L.

The tension T(x) at any string cross section at location x along the clamped length of the string L will be:

$$T(x) = T_o - \pi d \int_o^x \mu\, p(x)dx \tag{1}$$

where d is the string diameter, $T_o$ is the tension in the string at the forward or pulled end of the clamped length of string L, $\mu$ is the coefficient of friction between the inner surfaces of the wedges W1 and W2 and the string and p(x) is the clamping pressure at location x. Then the tensile stress $\sigma_x$ is given by:

$$\sigma_x = 4T(x)/(\pi d^2) \tag{2}$$

Ignoring the effect of the split between the wedges W1 and W2, the compressive stress at any point along the clamped length of string L is adequately given by $$\sigma_x = \sigma_y = -p(x) \tag{3}$$

and the shear stress on this surface by $$\tau_{xy} = \mu p(x) \tag{4}$$

and $\tau_{xz} = \tau_{yz} = 0$

Assume the distortion energy or Von Mises Henkey theory predicts onset of yielding. One is therefore interested in computing the maximum equivalent (combined) stress at critical points (i.e., particularly at the forward or pulled end of the clamped length of string L where the tensile stress $\sigma_x$ is greatest) in order to see if yielding is expected. The equivalent (combined) stress $\sigma_e$ is given by $$\sigma_e = \tfrac{1}{2}[(\sigma_x - \sigma_y)^2 + (\sigma_y - \sigma_z)^2 + (\sigma_z - \sigma_x)^3 + 3(\tau_{xy}^2 + \tau_{xz}^2 + \tau_{yz}^2)]^{\frac{1}{2}} \tag{5}$$

Consider first the uniform clamping pressure case illustrated in FIGS. 7(*a*) and 7(*b*). Here $$p(x) = P = T_o/(\mu\pi dL) \tag{6}$$

where L is the clamped length of string. At the forward or pulled end of the clamped length of string L:

$$\sigma_x = 4T_o/(\pi d^2),\ \sigma_y = -T_o/(\mu\pi dL)\tau_{xy} = \mu\sigma_y \tag{7}$$

For the case where L=0.25", d=0.55", $T_o$=55 lbs., $\mu$=0.5, the stresses will be $\sigma_x$=21,045 psi, $\sigma_z = \sigma_y = -2{,}315$ psi, $\tau_{xy}$=1,150 psi and thus the equivalent stress $\sigma_e$=23,445 psi at the forward or pulled end of the clamped length of string L. At the rearward or free end of the clamped length of string L for the uniform clamping pressure case:

$$\sigma_x = 0,\ \sigma_y = -2{,}315 \text{ psi},\ \tau_{xy} = 1{,}150 \text{ psi, and } \sigma_e = 3{,}054 \text{ psi} \tag{8}$$

Consider next the non-uniform clamping pressure case illustrated in FIGS. 8(*a*) and 8(*b*), there $$p(x) = 2T_o s/(\mu\pi dL^2) \tag{9}$$

Then at the forward or pulled end of the clamped length of string L:

$\sigma_x$=21,045 psi as before but $\sigma_y = \tau_{xy} = 0$ and therefore $\sigma_e$=21,045 psi, a reduction of 10% from the case of uniform clamping pressure.

At the rearward or free end of the clamped length of string L:

$$\sigma_x = 0,\ \sigma_y = -4{,}630 \text{ psi},\ \tau_{xy} = 2{,}315,\ \tau_e = 6{,}125 \text{ psi} \tag{10}$$

or an increase of 100% over the case of uniform clamping pressure.

Thus, it will be understood that the non-uniform clamping pressure has the beneficial effect of reducing the equivalent stress at the forward or pulled end of the clamped length of string L where this stress is the highest and where reduction is needed because it is at this point that the clamped length of string L first tends to yield or rupture and thus it is at this point where a reduction in equivalent stress is needed. Of course, it will be understood that non-uniform clamping pressure, as compared to uniform clamping pressure, does increase the equivalent stress at the rearward or free end of the clamped length of string L but at this point the shear stress in the clamped length of string L is quite low and therefore an increase in equivalent stress at this point is of no concern.

Figure 11:
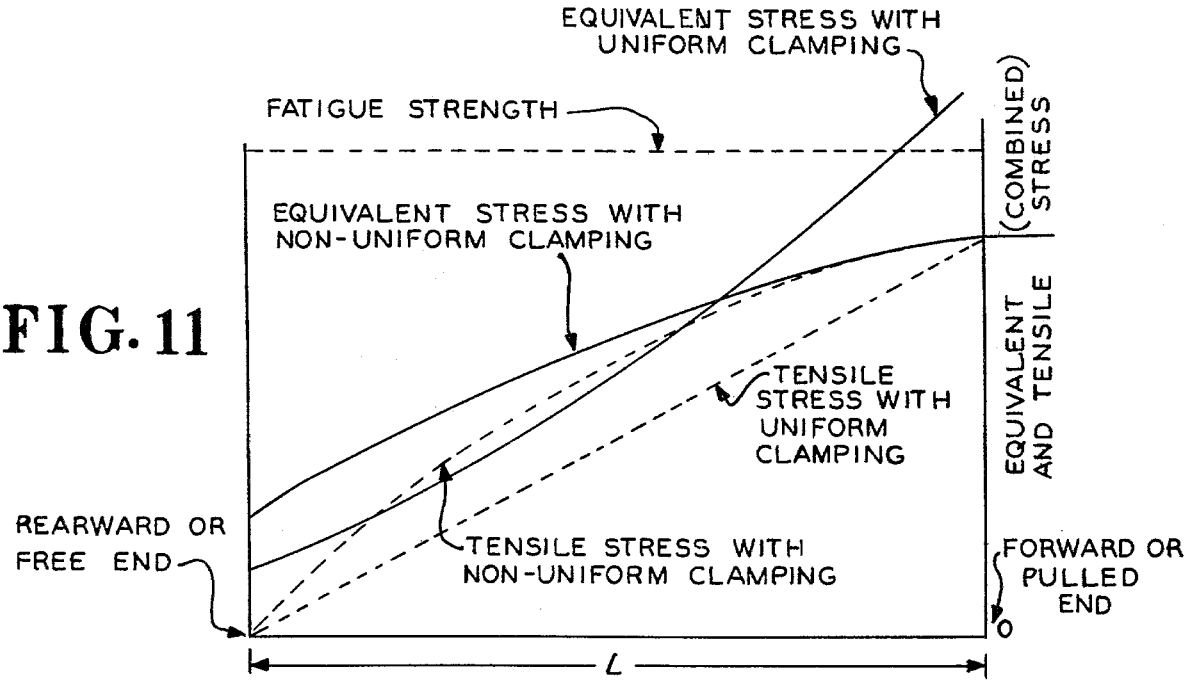
FIG. 11 is a graph illustrating the respective tensile stresses and equivalent stresses produced by the prior art clamping apparatus applying uniform clamping pressure and the improved clamping apparatus of the present invention applying non-uniform clamping pressure.
Figure 10:
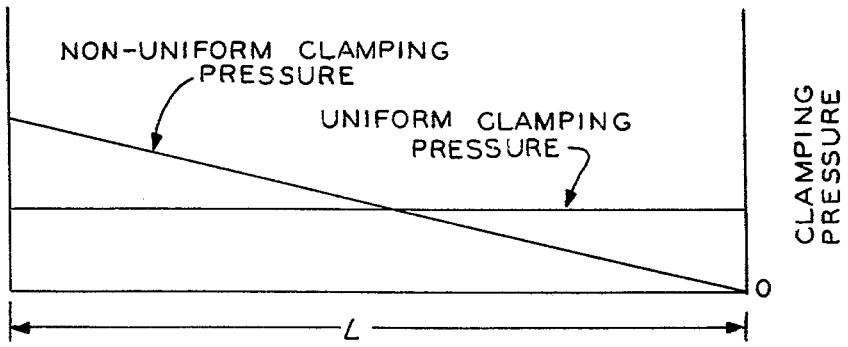
FIG. 10 is a graph illustrating the uniform clamping pressure provided by the prior art clamping apparatus and the non-uniform clamping pressure applied by the improved clamping apparatus of the present invention.

This is illustrated in FIGS. 10 and 11 showing stresses in a clamped length of string L clamped in a racket frame by opposed tapered wedges. In FIG. 10 there are shown graphs illustrating the application of uniform clamping pressure and non-uniform clamping pressure to the clamped length of string L. Above that figure (FIG. 10), is FIG. 11 which shows plots or graphs of the tensile stresses and equivalent stresses described and calculated above. For example, it will be noted in FIG. 11 that at the forward or pulled end of the clamped length of string L where the tensile stress is the highest and where failure or rupture is most likely, the equivalent stress provided by non-uniform clamping pressure is less than the equivalent stress provided by uniform clamping pressure. And hence, were the material of the string to have its failure strength at the level shown in FIG. 11, it is possible that the application of non-uniform clamping pressure in accordance with the teachings of the present invention could greatly reduce the likelihood of failure or rupture at the forward or pulled end of the clamped length of string by causing the equivalent stress to be below the failure strength of the string whereas the application of uniform clamping pressure in accordance with the teachings of the prior art could cause the equivalent stress at this critical point to exceed the failure strength of the string material and hence increase the likelihood of string failure or rupture.

The use of non-uniform clamping pressure in accordance with the teachings of the present invention had additional benefits in those embodiments of the present invention wherein the inner surfaces S2—S2 of the wedges W1 and W2 are provided with gripping teeth or are threaded as illustrated in FIG. 12. In the case of the uniform clamping pressure, the teeth or threads bite deeply into the clamped length of string L in the critical point where stress is highest, i.e. at the forward or pulled end of the clamped length of string L. This reduces the cross-sectional area of the string available to resist tension thus raising the tensile stress $\sigma_x$ to a higher value than that predicted by equation (2) above. The yielding resulting from this bite or notch also produces substantial yielding exactly at the noted critical point where stress is highest; this yielding predisposes the string to earlier fatigue or overload failure. Additionally, the bite or notch produced by the deeper bite of the teeth or thread results in a stress combination further raising the stress at the critical point, and thus further decreases fatigue resistance of the string material. These adverse effects are greatly reduced by the application of non-uniform clamping pressure since in accordance with the teachings of the present invention the wedges W1 and W2 engage the clamped length of string L in graduated contact and hence, as illustrated in FIG. 12, the teeth or threads formed on the inner surface of the wedges at the forward end thereof make a much smaller bite or notch in the string at the forward or pulled end of the string where the stress, tensile stress and equivalent stress is the highest.

Referring again to the gripping teeth provided on the inner surfaces S2—S2 of the wedges W1 and W2 of the present invention as disclosed with regard to FIG. 12, and referring now to FIG. 13, it will be further understood that in accordance with the teachings of the present invention the gripping teeth provided on the opposed inner surfaces S1—S2 of the wedges, such as for example the teeth T1 and T2 shown diagrammatically in FIG. 13, may be staggered with respect to each other to decrease the indentation of the teeth into the clamped length of string L and thereby further reduce the tendency of the clamped length of string L to rupture. The gripping teeth T1 and T2 may either be spiral threaded teeth or, in the alternative, may be formed concentrically.

With further regard to the gripping teeth, upon such gripping teeth T1 and T2 being formed as spiralled threads, it will be further understood that in accordance with the teachings of the present invention such teeth may be cross-threaded, as shown diagrammatically in FIG. 14, to decrease the indentation of the teeth into the clamped length of string L and thereby further reduce the tendency of the clamped length of string L to rupture.

An alternate embodiment of the wedges W1 and W2 of the improved clamping apparatus of the present invention is shown diagrammatically in FIG. 15 wherein such wedges instead of being provided with a differential taper between the respective included angles A1 and A2 are instead provided on their opposed, cylindrical inner surfaces S2—S2 with gripping teeth of varying length which decrease from a maximum length at the rearward or free end of the clamped length of string L to a minimum length at the forward or pulled end of the clamped length of string L. Thus, upon such wedges being wedgingly received within the grommet G of FIG. 4, due to such opposed gripping teeth being of varying length, the opposed wedges W1 and W2 will engage the clamped length of string L in graduated contact and apply the non-uniform clamping pressure 17 as shown in FIG. 6. The gripping teeth T1 and T2 of the alternate embodiment of the present invention illustrated diagrammatically in FIG. 15 may also be either spiral threaded teeth or may be formed concentrically and may also be staggered as illustrated in FIG. 13 or cross-threaded as illustrated in FIG. 14.

It will be also understood that FIG. 15 is also a diagrammatic illustration of a further embodiment of the present invention wherein the opposed gripping teeth T1 and T2 for causing the wedges W1 and W2 to engage the clamped length of string L in graduated contact to apply the non-uniform clamping pressure may be each formed of a spiral thread of varying pitch which decreases from a coarse pitch at the rearward or free end of the clamped length of string L to a light pitch at the forward or pulled end of the clamped length of string L. Such teeth would be formed with a constant pitch diameter, the noted varying pitch thereby providing the varying height of the gripping teeth T1 and T2 as illustrated in FIG. 15.

Figure 16:
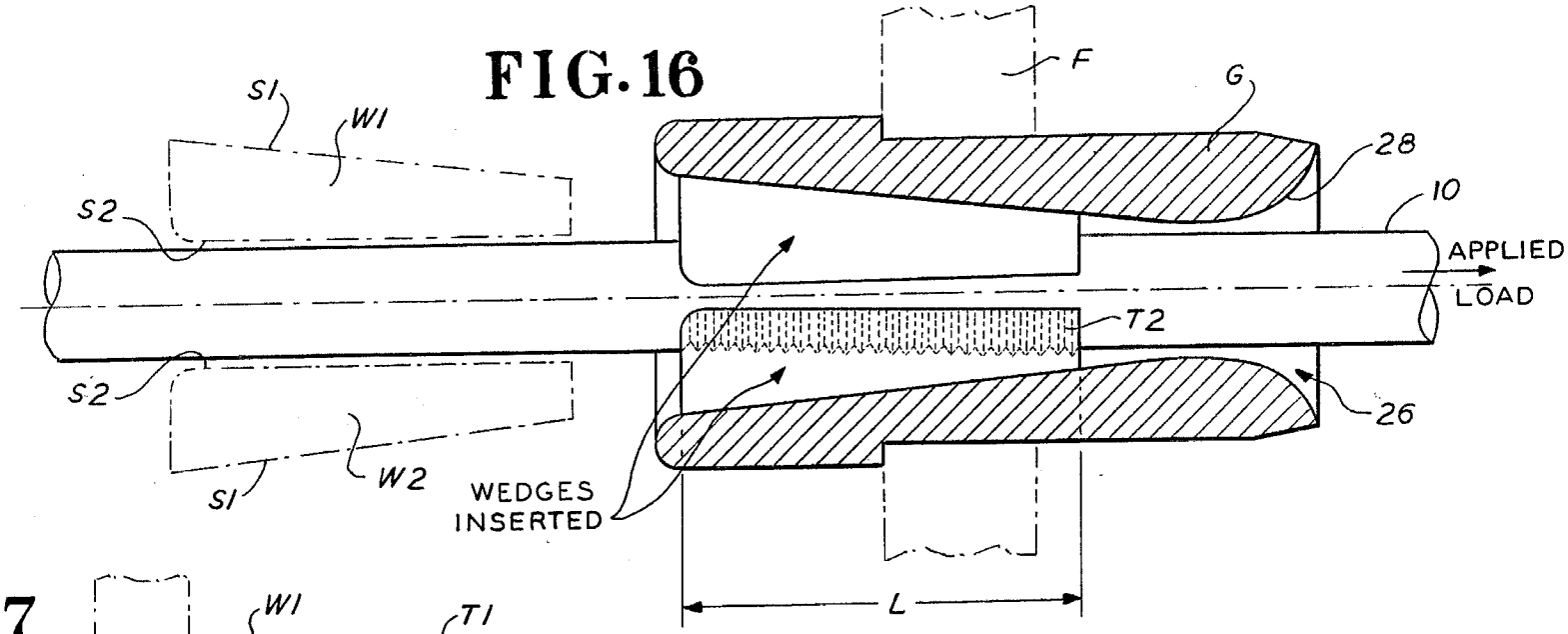
FIG. 16 is a detailed drawing of an embodiment of the improved clamping apparatus of the present invention.

An actual embodiment of the improved clamping apparatus of the present invention is shown in FIGS. 16–19. In the leftward portion of FIG. 16, the wedges W1 and W2 are shown ready for insertion into the grommet G, such wedges being shown in dashed outline, and in the rightward portion of FIG. 16, the wedges W1 and W2 are shown as being wedgingly received within the grommet G to engage the clamped length of string L with graduated contact to apply the non-clamping pressure noted above. It will be understood that in this embodiment the outer conical surfaces S1—S2 of the wedges W1 and W2 are provided with a differential taper with respect to the inner passageway S3 formed in the grommet G as taught in detail above with respect to FIG. 4. The forward end 26 of the grommet G, as shown in FIG. 16, may be provided with a generally annularly shaped strain relief portion 28 defined in cross section, as shown, by a smooth curve extending from the inner surface S3 of the grommet G to the outer surface of the grommet. The strain relief portion 28 is for decreasing bending stresses and reducing fretting in the string 10 upon the string being bent around the forward end 26 of the grommet upon the string impacting with a game ball during play.

Figure 19:
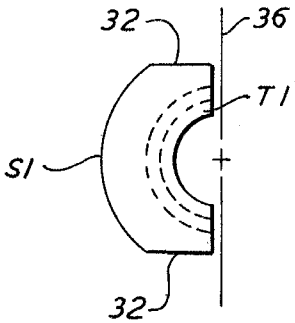
FIGS. 17, 18 and 19 are detailed drawings of an embodiment of a single, tapered wedge of the improved clamping apparatus of the present invention.
Figure 17:
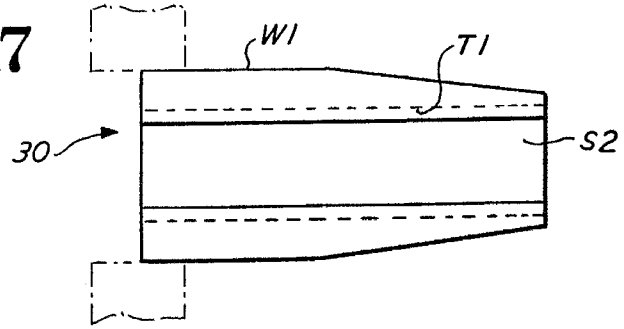
Figure 18:
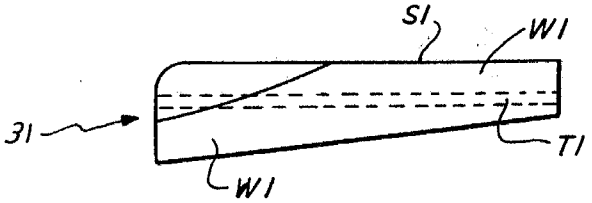
Figure 22:
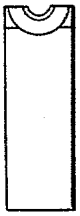
FIGS. 20–24 are detailed drawings of an alternate embodiment of a tapered wedge of the improved clamping apparatus of the present invention.
Figure 23:
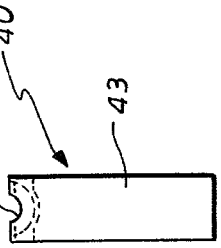

Referring now to FIGS. 17–19, there is shown in detail a wedge of the improved clamping apparatus of the present invention, for example wedge W1, which illustrates a further teaching of the present invention, namely that the rearward end 30 of such wedges may be provided with opposed flat portions 32—32 provided along the conical outer surface S1. Upon the opposed wedges being wedgingly received within the grommet G as illustrated diagrammatically in FIG. 5, the inner surfaces S2—S2 of the wedges are separated by a plane of separation 36, as illustrated in FIG. 14, whereby it will be understood that the opposed flat portions 32—32 formed at the rearward end 30 of such wedges are generally perpendicular to the plane of separation whereby such opposed flat surfaces 32—32 facilitate the reception of the wedges within the tapered passageway formed in the grommet G.

Referring again to FIG. 5, it will be further understood that in accordance with the teachings of the improved clamping apparatus of the present invention the opposed tapered wedges W1 and W2 upon being received within the tapered passageway 11 formed in the grommet G, and upon the outer conical surfaces S1 and S2 of such wedges being provided with the above-noted differential taper with respect to the inner surface S3 formed in the grommet G, the opposed cylindrical surfaces S2—S2 will provide a second tapered passageway as shown in FIG. 5 which increases from a minimum diameter at the rearward or free end of the clamped length of string L to a minimum in diameter at the forward or pulled end of the clamped length of string L whereby such inner surfaces S1—S2 apply the above-noted non-uniform clamping pressure to said clamped length of string L which non-uniform clamping pressure, as illustrated at 17 in FIG. 6, is maximum at the rearward or free end 20 of the clamped length of string L and is minimum at the forward or pulled end 18 of the clamped length of string L. In one embodiment of the improved clamping apparatus of the present invention, the included angle A2 defined by the outer conical surfaces S1—S1 of the wedges W1 and W2, illustrated in FIG. 4, is substantially 2° greater than the included angle A1 defined by the tapered inner surface S3 of the grommet G.

The wedges W1 and W2 of the improved clamping apparatus of the present invention may be further provided at the rearward end with an integrally formed handle 40 as shown in detail in FIGS. 20–24 with regard to wedge W1. The handle 40 is for being gripped by an operator to facilitate initial insertion of the wedge into the tapered passageway 11 (FIG. 4) and the handle is for being broken off from the wedge after the wedge is inserted into the grommet passageway 11. More specifically, and as shown in detail in FIG. 20, the handle 40 may include a longitudinally extending portion 41 generally linearly aligned with the wedge W2, a downwardly extending portion 43 and an intermediate portion 45 of reduced cross section, as shown specifically in FIG. 24, interconnecting the longitudinally extending portion 41 with the rearward end of the wedge W1. Further, the longitudinally extending portion 41 may be provided in its upper surface with a groove 47 for partially surrounding the string 10 as illustrated in FIG. 16, to facilitate alignment of the wedge with respect to the string 10. The intermediate portion 45, due to its reduced cross-sectional shape, facilitates the breaking off of the handle 40 from the wedge W2 upon the longitudinally and downwardly extending portions 41 and 43 being bent downwardly or twisted with respect to the wedge W1 to thereby separate the handle 40 from the wedge W1.

Figure 20:
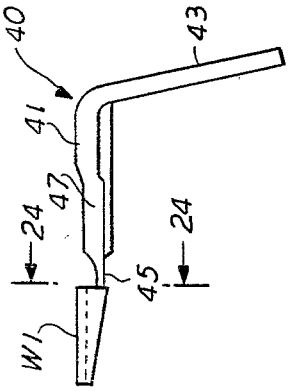

Various techniques may be utilized to insert and install the wedges W1 and W2 in the grommet G. The wedges can be installed manually by an operator particularly upon the wedges being provided with the handle 40 as shown in FIG. 20. The string 10 is fed through the grommet G of FIG. 16 and the operator grips the handles 40 (FIG. 20) and aligns the inner surfaces S2—S2 of the wedges with the outer surface of the string to cause the wedges to substantially surround the string. The forward portions of the wedges are than initially manually inserted into the grommet and then upon the string being tensioned the wedges are pulled into the passageway due to the friction between the teeth on the inner surfaces S2—S2 of the wedges and the string whereby the wedges are wedgingly received within the grommet and the string is clamped to the frame F of the game ball racket.

Figure 25B:
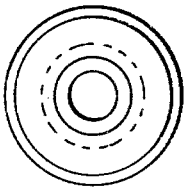
FIGS. 25(*a*) and (*b*) are respectively side and end views of a wedge insertion tool useful in inserting the wedges of the present invention.
Figure 25B:
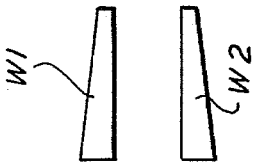
Figure 21:
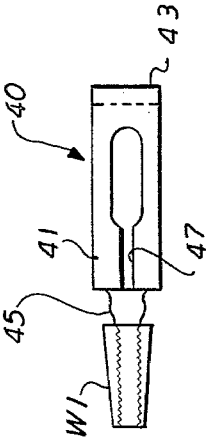
Figure 24:
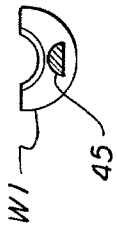
Figure 25A:
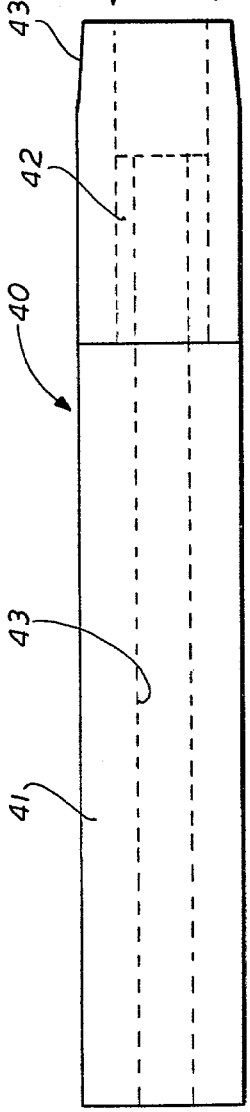

Alternatively, the wedges without the handles 40 can be readily inserted in the grommet G by the insertion tool 40 shown in FIGS. 25 (*a*) and 26 (*b*). The insertion tool 40 includes a first member 41 of generally cylindrical shape and of a rigid material such as a suitable metal and which is provided at its forward end with a cylindrical protrusion 42 shown in dashed outline. Surrounding the protrusion 42 and extending beyond is a second member 43 also of generally cylindrical shape and which is of a resilient material such as a silicone rubber. A passageway 43 of circular cross-sections extends through the member 41 and protrusion 42 is for receiving the string 10. The wedges W1 and W2 are manually inserted into the forward end of the tool 40 as indicated by the arrows in FIG. 25 (*a*) with the rearward ends of the wedges abutting the annular end of the protrusion 42, with the outer conical surfaces S1—S1 of the wedges engaging the inner surface of the resilient member 43 and with the inner surfaces S2—S2 in face-to-face orientation. To clamp the opposite ends of an individual string to the frame of a game ball racket two insertion tools 40 are utilized. One insertion tool is threaded over the long end of a supply of string, which long end will be subsequently tensioned, and the other tool will be used to clamp the short end or free end of the string to the racket frame. Each insertion tool is now loaded as described above. At the short end of the string, the string is inserted between the wedges and the insertion tool is pressed firmly into its grommet to initially seat its wedges; then this tool is removed. At the long end the string is tensioned and then the second tool is pressed firmly into a grommet to initially seat its wedges. External tension is removed and the string cut adjacent to the grommets. The tensioned string slightly contracts which, due to the friction between the wedges and the string, finally seats the wedges in the grommets therely firmly clamping the opposite ends of the string to the frame of the game ball racket.

Figure 9:
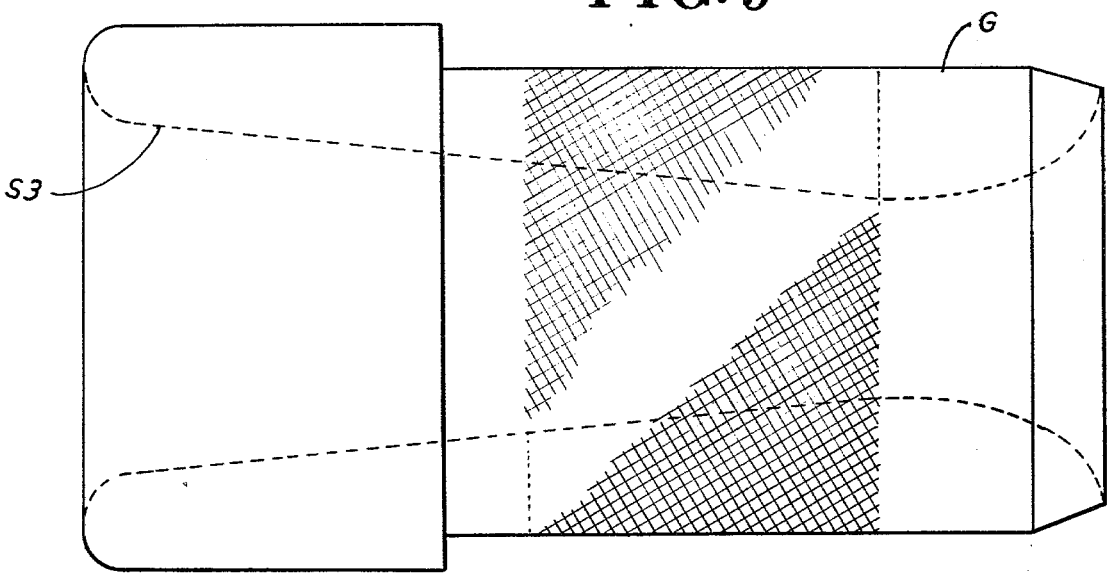
FIG. 9 shows a knurled grommet useful in the present invention.

Referring now to FIG. 9, there is shown a further embodiment of the grommet G of the present invention wherein it will be understood that the outer surface of the grommet may be knurled as shown to provide an interference fit between the grommet and the hole formed in the frame F of the racket through which the grommet is inserted. It has been found that such knurling further assists in maintaining the grommets G in the holes formed in the racket frame F prior to and during insertion of the wedges and during stringing.

With further regard to the drawings, it will be understood by those skilled in the art that various relative dimensions and sizes of the elements shown in the drawings have been exaggerated to enhance and further clarify the understanding of the present invention. For example, the relative sizes of the included angles A1 and A2 shown in FIG. 4 have been exaggerated to enhance and clarify an understanding of the differential taper.

Further, it will be understood by those skilled in the art that it is within the spirit and scope of the present invention to provide the wedges W1 and W2 and the grommet G with shapes and configurations other than those shown specifically to cause clamping apparatus to apply non-uniform clamping pressure to the clamped length of string L. Still further, it will be understood that various other modifications and variations may be made in the present invention without departing from the spirit and the scope thereof.

What is claimed is:

1. In clamping apparatus extending through a passageway formed in the frame of a game ball racket and which clamping apparatus is for applying clamping pressure to a length of a game ball string adjacent an end thereof to clamp said length of string to said game ball racket frame, and wherein upon said length of string being clamped to said game ball racket frame and upon said string being placed in tension due to stringing and play, tensile stress of varying magnitude is produced in said clamped length of string which tensile stress is a maximum at the forward or pulled end of said clamped length of string and which tensile stress decreases to a minimum at the free or rearward end of said clamped length of string, wherein the improvement comprises:

improved clamping apparatus for engaging said clamped length of string in graduated contact to apply non-uniform clamping pressure to said clamped length of string which non-uniform clamping pressure is minimum at said forward or pulled end of said clamped length of string where said tensile stress is maximum and which non-uniform pressure increases to a maximum at said free or rearward end of said clamped length of string where said tensile stress is minimum whereby the tendency of said clamped length of string to rupture at said forward or pulled end of said clamped length of string is reduced.

2. In clamping apparatus according to claim 1 wherein said improved clamping apparatus for engaging said clamped length of string in graduated contact comprises a grommet extending through said game ball racket frame and a pair of opposed, tapered wedges wedgingly received within said grommet, said grommet provided with a tapered inner surface and said wedges provided with inner and outer surfaces, and wherein a differential taper is provided between said inner surface of said grommet and said outer surfaces of said wedges to thereby provide said graduated contact.

3. In clamping apparatus according to claim 2 wherein said inner surfaces of said wedges are provided with teeth for engaging said clamped length of string and wherein the teeth formed on the inner surface of one of said wedges is staggered with respect to the teeth formed on the inner surface of the other of said wedges to decrease the indentation of said teeth into said clamped length of string and thereby further reduce said tendency of said clamped length of string to rupture.

4. In clamping apparatus according to claim 2 wherein said inner surfaces of said wedges are threaded and wherein the thread formed on the inner surface of one of said wedges is cross-threaded with respect to the thread formed on the inner surface of the other of said wedges to decrease the indentation of said teeth into said clamped length of string and thereby further reduce said tendency of said clamped length of string to rupture.

5. In clamping apparatus according to claim 1 wherein said improved clamping apparatus for engaging said clamped length of string in graduated contact comprises a pair of opposed, tapered wedges having inner surfaces and which wedges are for being wedgingly received within a tapered passageway extending through said frame of said game ball racket, said inner surfaces of said wedges provided with teeth of varying length which decrease from a maximum length at the rearward or free end of said clamped length of string to a minimum at said forward or pulled end of said clamped length of string.

6. In clamping apparatus according to claim 1 wherein said improved clamping apparatus for engaging said clamped length of string in graduated contact comprises a pair of opposed, tapered wedges having inner surfaces and which wedges are wedgingly received within a tapered passageway formed in the frame of said game ball racket, said inner surfaces of said wedges being threaded with a thread of varying pitch which decreases from a coarse pitch at the rearward or free end of said clamped length of string to a light pitch at said forward or pulled end of said clamped length of string.

7. Clamping apparatus according to claim 1 wherein said clamped length of string has a center line and wherein said clamping apparatus for applying non-uniform clamping pressure to said clamped length of string comprises:

a generally cylindrically shaped grommet extending through said passageway formed in said frame of said game ball racket, said grommet provided with a generally cylindrically shaped, tapered inner surface forming a tapered passageway extending through said racket frame and said tapered inner surface forming a first included angle with respect to said center line; and a pair of opposed tapered wedges for being received within said tapered passageway formed in said grommet, said wedges provided with substantially cylindrical inner surfaces for substantially surrounding and engaging said clamped length of string and provided with substantially conical outer surfaces forming a second included angle with respect to said center line, said second included angle being greater than said first included angle whereby upon said wedges being forced into said tapered passageway formed in said grommet, said outer surfaces of said wedges align with said tapered inner surface of said grommet and said inner surfaces of said wedges are forced into graduated contact with said clamped length of string which graduated contact decreases from the rearward end of said clamped length of string where the graduated contact is maximum to the pulled or forward end of the clamped length of string where the graduated contact is minimum, said graduated contact applying said non-uniform clamping pressure to said clamped length of string.

8. In clamping apparatus according to claim 7 wherein upon said wedges being received within said tapered passageway formed in said grommet, said inner surfaces of said wedges are separated by a plane of separation, and wherein each of said wedges is provided at the rearward end thereof along said conical outer surface with a pair of opposed flat portions generally perpendicular to said plane of separation, said flat portions reducing interference between said outer conical surfaces of said wedges and said tapered inner surface formed in said grommet to thereby facilitate the reception of said wedges within said tapered passageway provided by said grommet.

9. In clamping apparatus according to claim 7 wherein said generally cylindrically shaped grommet is provided with a forward end for surrounding said forward or pulled end of said clamped length of string and which forward end of said grommet is provided with a generally annularly shaped strain relief portion defined in cross section by a smooth curve extending from said inner surface of said grommet to the outer surface of said grommet, said strain relief portion for decreasing bending stresses produced in said string upon said string being bent around said forward end of said grommet upon said string impacting a game ball during play.

10. Clamping apparatus according to claim 7 wherein each of said wedges is provided at the rearward end thereof with an integrally formed handle, said handle for being gripped by an operator to facilitate initial insertion of the wedge into the passageway formed in said grommet and said handle for being broken off from said wedge after said wedge is inserted into said grommet passageway.

11. Clamping apparatus according to claim 7 wherein each of said wedges is provided at the rearward end thereof with an integrally formed handle, said handle including a longitudinally extending portion generally linearly aligned with said wedge, a downwardly extending portion and an intermediate portion of reduced cross section interconnecting said longitudinally extending portion with the rearward end of said wedge, said longitudinally extending portion having a groove formed in the upper surface thereof for partially surrounding said string to facilitate alignment of said wedge with respect to said string, and said handle for being gripped by an operator to facilitate initial insertion of said wedge into said passageway formed in said grommet and upon said wedge being initially inserted into said grommet, said intermediate portion of reduced cross section for breaking upon said longitudinally and downwardly extending portion being bent downwardly or twisted with respect to said wedge to thereby separate said handle from said wedge.

12. In clamping apparatus according to claim 1 wherein said improved clamping apparatus for engaging said clamped length of string in graduated contact comprises a grommet extending through said game ball racket frame and a plurality of opposed, tapered wedges wedgingly received within said grommet, said grommet provided with a tapered inner surface and said wedges provided with inner and outer surfaces, and wherein a differential taper is provided between said inner surface of said grommet and said outer surfaces of said wedges to thereby provide said graduated contact.

13. In apparatus for clamping an end of a game ball string to the frame of a game ball racket, wherein said apparatus includes a pair of opposed, tapered wedges, for substantially surrounding a length of said string adjacent an end thereof and for being wedgingly received within a tapered passageway extending through said frame of the racket to cause the inner surfaces of said wedges to apply clamping pressure to said length of string and to thereby clamp said length of string to said game ball racket frame, and wherein upon said clamped length of string being clamped to said game ball racket frame, and upon said string being placed in tension due to stringing and due to the string impacting with a game ball during play, tensile stress is produced in said clamped length of string which tensile stress is maximum at the forward or pulled end thereof and which tensile stress decreases to a minimum at the rearward or free end thereof, and wherein upon the inner surfaces of said wedges being substantially aligned parallel with said length of string said outer surfaces of said wedges form an included angle with respect to the centerline of said string and wherein said tapered passageway forms an included angle with respect to said centerline of said string, wherein the improvement comprises:

said included angle formed by said outer surfaces of said wedges being greater than said included angle formed by said tapered passageway whereby upon said wedges substantially surrounding said length of string and being wedgingly received within said tapered passageway, said outer surfaces of said wedges align with said tapered passageway and said inner surfaces of said wedges form a second generally conical tapered passageway along at least a substantial portion of said clamped length of string which second tapered passageway increases from a minimum in diameter at said rearward or free end of said clamped length of string to a maximum in diameter at said forward or pulled end of said clamped length of string whereby said inner surfaces of said wedges apply non-uniform clamping pressure to said clamped length of string which non-uniform clamping pressure is maximum at said rearward or free end of said clamped length of string and which non-uniform clamping pressure is minimum at said forward or pulled end of said clamped length of string whereby the tendency of said string to rupture at said forward or pulled end of said clamped length of string is reduced.

14. Apparatus according to claim 13 wherein said included angle formed by said outer surfaces of said wedges is substantially 2° greater than said included angle formed by said tapered passageway.

15. A clamping wedge for use in clamping the end of a game ball string in a passageway formed in the frame of a game ball racket, comprising:

a generally tapered body of material having a substantially conical outer surface and a substantially cylindrical inner surface, and having forward and rearward ends with the rearward end thereof being substantially transverse with respect to said body of material;

a handle formed integrally with said body of material at the rearward end thereof, said handle including a longitudinally extending portion generally linearly aligned with said body of material, a downwardly extending portion and an intermediate portion of reduced cross section interconnecting said longitudinally extending portion with the rearward end of said wedge, said longitudinally extending portion having a groove formed in the upper surface thereof for partially surrounding said string to facilitate alignment of said wedge with respect to said string; and said handle for being gripped by an operator to facilitate at least the initial insertion of said wedge into said passageway and upon said wedge being inserted into said passageway said intermediate portion of reduced cross section for breaking upon said longitudinally and downwardly extending portion being bent downwardly or twisted with respect to said wedge to thereby separate said handle from said body of material.

* * * * *

Disclaimer 4,309,033.—*Charles L. Parker, Jr.* and *George A. Vaughn,* Princeton, N.J. CLAMPING APPARATUS. Patent dated Jan. 5, 1982. Disclaimer filed Aug. 8, 1983, by the assignee, *AMF Inc.*

Hereby enters this disclaimer to claims 1-7 and 12-14 of said patent.

[*Official Gazette September 20, 1983.*]